US006213094B1

(12) United States Patent
Onishi et al.

(10) Patent No.: US 6,213,094 B1
(45) Date of Patent: Apr. 10, 2001

(54) HIGH-PRESSURE FUEL PUMP

(75) Inventors: Yoshihiko Onishi; Kouichi Ojima; Takemi Arima; Hideki Morikaku, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/480,664

(22) Filed: Jan. 11, 2000

(30) Foreign Application Priority Data

Aug. 20, 1999 (JP) ..... 11-234325

(51) Int. Cl.[7] ..... F02M 37/00
(52) U.S. Cl. ..... 123/447; 123/495
(58) Field of Search ..... 123/495, 467, 123/446, 447

(56) References Cited

U.S. PATENT DOCUMENTS 6,053,712 * 4/2000 Konishi ..... 123/495
6,059,547 * 5/2000 Konishi ..... 123/495
6,102,010 * 8/2000 Isozumi et al. ..... 123/495

FOREIGN PATENT DOCUMENTS 10-331735 12/1998 (JP) .

* cited by examiner

*Primary Examiner*—Thomas N. Moulis
(74) *Attorney, Agent, or Firm*—Sughrue, Mion, Zinn, Macpeak & Seas, PLLC

(57) ABSTRACT

In a high-pressure fuel pump, a back-pressure chamber connected to a high-pressure fuel discharge passage is formed in a casing facing a central portion of a first plate.

7 Claims, 7 Drawing Sheets

HIGH-PRESSURE FUEL PUMP

BACKGROUND OF THE INVENTION

1. Field of the Invention

The present invention relates to a high-pressure fuel pump installed in a high-pressure fuel supply assembly used in a cylinder-injected engine, for example.

2. Description of the Related Art

FIG. 5 is a block diagram of a conventional high-pressure fuel supply assembly 100, and FIG. 6 is a cross section thereof. This high-pressure fuel supply assembly 100 includes: a low-pressure damper 2 for absorbing surges in low-pressure fuel, the low-pressure damper 2 being connected to a low-pressure fuel intake passage 1 through which flows low-pressure fuel from a low-pressure fuel pump (not shown); a high-pressure fuel pump 3 for pressurizing low-pressure fuel from the low-pressure damper 2; a high-pressure damper 5 for absorbing surges in the high-pressure fuel flowing through a high-pressure fuel discharge passage 4 connected to the high-pressure fuel pump 3; and a check valve for improving the starting of an engine by maintaining fuel in delivery pipes 8 at high pressure even when the engine is stopped, the check valve being disposed between the high-pressure damper 5 and a fuel supply port 7 and opening when the fuel pressure on the delivery pipe 8 side is lower than the fuel pressure on the high-pressure damper 5 side. Moreover, in the drawings, 17 is a passage connecting to a high-pressure regulator (not shown) from between the fuel supply port 7 and the delivery pipe 8.

The above low-pressure damper 2 is mounted in a first recess 10*a* in a casing 10. The low-pressure damper 2 includes: a cylindrical holder 14; a base 13 having a ball 11 disposed in a bore 12; and a metal bellows 15 disposed inside the holder 14.

The above high-pressure fuel pump 3 includes: a valve assembly 20 for opening and closing the low-pressure fuel intake passage 1 and the high-pressure fuel discharge passage 4; and a high-pressure fuel supply body 21 for pressurizing low-pressure fuel and discharging it into the high-pressure fuel discharge passage 4.

FIG. 7 is a cross section of the valve assembly 20, the valve assembly 20 being composed of a first plate 22, a second plate 23, and a thin, flat valve main body 19 positioned between the first and second plates 22 and 23. A first fuel inlet 24 connected to the low-pressure fuel intake passage 1 and a first fuel outlet 25 connected to the high-pressure fuel discharge passage 4 are formed in the first plate 22, the inside dimensions of the first fuel outlet 25 being larger than the inside dimensions of the first fuel inlet 24. A second fuel inlet 26 having inside dimensions larger than those of the first fuel inlet 24 and a second fuel outlet 27 having inside dimensions smaller than those of the first fuel outlet 25 are formed in the second plate 23. The valve main body 19 is provided with an intake-side tongue 28 interposed between the first fuel inlet 24 and the second fuel inlet 26, and a discharge-side tongue 29 interposed between the first fuel outlet 25 and the second fuel outlet 27.

The high-pressure fuel supply body 21 includes: a casing 10 housing the valve assembly 20 inside a second recess 10*b;* a cylindrical sleeve 30 housed in surface contact with the second plate 23 of the valve assembly 20; a piston 33 slidably inserted inside the sleeve 30 forming a fuel pressurization chamber 32 in cooperation with the sleeve 30; and a first spring 36 disposed between a recessed bottom surface 34 of the piston 33 and a holder 35, the spring 36 applying force to the piston 33 in a direction which expands the volume of the fuel pressurization chamber 32.

The high-pressure fuel supply body 21 also includes: a housing 37 fitted over the sleeve 30; a ring-shaped securing member 38 securing the valve assembly 20, the sleeve 30, and the housing 37 inside the second recess 10*b* of the casing 10 by fitting over the housing 37 and engaging the second recess 10*b* of the casing 10 by a male thread portion formed on an outer circumferential surface of the securing member 38; a metal bellows 40 disposed between the housing 37 and a receiving portion 39; a second spring 41 compressed and disposed around the outside of the bellows 40 between the housing 37 and a holder 42; and a bracket 43 disposed to surround the second spring 41, the bracket 43 being secured to the casing 10 by a bolt (not shown).

The high-pressure fuel supply body 21 also includes: a tappet 44 slidably disposed in a slide bore 43*a* in an end portion of the bracket 43; a pin 45 rotatably suspended in the tappet 44; a bush 46 rotatably disposed on the pin 45; and a cam roller 47 rotatably disposed on the bush 46, the cam roller 47 contacting a cam (not shown) secured to a cam shaft (not shown), following the shape thereof, and reciprocating the piston 33.

The above high-pressure damper 5 is screwed into a third recess 10*c* in the casing 10. The high-pressure damper 5 includes: a first case 50; a second case 51 disposed opposite the first case 50, the second case 51 forming a space in cooperation with the first case 50; and a thin, flat disk-shaped stainless steel diaphragm 54 dividing the space into a back-pressure chamber 52 charged with high-pressure gas and a buffer chamber 53. The diaphragm 54 moves so that the pressure of the fuel flowing into the buffer chamber 53 from the high-pressure fuel discharge passage 4 is equalized with the pressure of the high-pressure gas in the back-pressure chamber 52, thereby changing the volume inside the buffer chamber and absorbing surges in the fuel in the high-pressure fuel discharge passage 4.

In a high-pressure fuel supply assembly 100 having the above construction, the piston 33 is reciprocated by the rotation of the cam secured to the cam shaft of an engine (not shown) by means of the cam roller 47, the bush 46, the pin 45, and the tappet 44.

When the piston 33 is descending (during the fuel intake stroke), the volume of the inside of the fuel pressurization chamber 32 increases and the pressure inside the fuel pressurization chamber 32 decreases. When the pressure inside the fuel pressurization chamber 32 falls below the pressure at the first fuel inlet 24, the intake-side tongue 28 of the valve main body 19 bends towards the second fuel inlet 26, allowing fuel in the low-pressure fuel supply passage 1 to flow through the first fuel inlet 24 into the fuel pressurization chamber 32.

When the piston 33 is ascending (during the fuel discharge stroke), the pressure inside the fuel pressurization chamber 32 increases, and when the pressure inside the fuel pressurization chamber 32 rises above the pressure at the first fuel outlet 25, the discharge-side tongue 29 of the valve main body 19 bends towards the first fuel outlet 25, allowing fuel in the fuel pressurization chamber 32 to flow through the first fuel outlet 25 and the fuel discharge passage 4 into the high-pressure damper 5, where fuel pressure surges are absorbed. High-pressure fuel is then supplied to the delivery pipes 8 via the check valve 6 and the fuel supply port 7, and thereafter supplied to the fuel injection valves 9, which inject fuel into each of the cylinders (not shown) of the engine.

In the high-pressure fuel pump 3 of the high-pressure fuel supply assembly 100 of the above construction, the housing 37, the sleeve 30, and the valve assembly 20 are held inside the second recess 10*b* by the securing member 38. Because the securing member 38 presses on an outer circumferential portion of the housing 37, the valve assembly 20 is subjected to a large load from the casing 10 at an outer circumferential portion of the valve assembly 20, and to an extremely small load at a central portion of the valve assembly 20. FIG. 6 shows the distribution of the load at that time, and it can be seen that the load increases radially outwards.

At the central portion of the valve assembly 20, the pressure bearing on the valve assembly 20 is extremely low, and during the fuel intake stroke, when the load acting on a peripheral portion 27*a* of the second fuel outlet 27 on the second plate 23 through the discharge-side-tongue 29 at the mouth of the first fuel outlet 25 corresponds to the cross-sectional area of the mouth multiplied by the discharge pressure, there is a risk that the second plate 23 will be deformed by the load towards the piston 33 in the vicinity of the central portion where the pressure bearing on the peripheral portion 27*a* is extremely low.

Similarly, during the fuel discharge stroke, when the load acting on a peripheral portion 24*a* of the first fuel inlet 24 on the first plate 22 through the intake-side tongue 28 at the mouth of the second fuel inlet 26 due to the high pressure in the fuel pressurization chamber 32 corresponds to the cross-sectional area of the mouth multiplied by the pressure inside the fuel pressurization chamber, there is a risk that the first plate 22 will be deformed by the load towards the high-pressure damper 5 in the vicinity of the central portion where the pressure bearing on the peripheral portion 24*a* is extremely low.

When the second plate 23 or the first plate 22 bend in this manner, even though there should not normally be any gap between the second plate 23 and the discharge-side tongue 29 during the fuel intake stroke, a gap forms between the second plate 23 and the discharge-side tongue 29 in the vicinity of the central portion where the bearing pressure is extremely low. Similarly, even though there should not normally be any gap between the first plate 22 and the intake-side tongue 28 during the fuel discharge stroke, a gap forms between the first plate 22 and the intake-side tongue 28 in the vicinity of the central portion where the bearing pressure is extremely low. Consequently, when the discharge pressure is high, one problem has been that fuel leaks out from between the second plate 23 and the discharge-side tongue 29 during the fuel intake stroke, and out from between the first plate 22 and the intake-side tongue 28 during the fuel discharge stroke, dramatically reducing volumetric efficiency {(the actual amount of fuel discharged into the high-pressure fuel discharge passage 4 from the fuel pressurization chamber 32 during one stroke of the piston 33)/(the cross-sectional area of the piston 33× the stroke distance)}. Another problem has been that due to the formation of the above gaps, fretting occurs in places other than the intake-side tongue 28 and the discharge-side tongue 29 of the valve main body 19, such as between elements of the casing 10, the valve assembly 20, and the sleeve 30, giving rise to fuel leaks from gaps there and reducing the discharge flow.

SUMMARY OF THE INVENTION

The present invention aims to solve the above problems and an object of the present invention is to provide a high-pressure fuel pump with improved volumetric efficiency in which valve fretting is prevented.

To this end, according to the present invention, there is provided a high-pressure fuel pump comprising: a valve assembly disposed between a low-pressure fuel intake passage and a high-pressure fuel discharge passage, the valve assembly opening and closing the low-pressure fuel intake passage and the high-pressure fuel discharge passage; and a high-pressure fuel supply body for pressurizing low-pressure fuel flowing from the low-pressure fuel intake passage and discharging pressurized fuel into the high-pressure fuel discharge passage, the valve assembly including: a first plate having a first fuel inlet connected to the low-pressure fuel intake passage, and a first fuel outlet connected to the high-pressure fuel discharge passage; a second plate having a second fuel inlet having inside dimensions larger than inside dimensions of the first fuel inlet, and a second fuel outlet having inside dimensions smaller than inside dimensions of the first fuel outlet; and a thin, flat valve main body positioned between the first plate and the second plate, the valve main body having an intake-side tongue interposed between the first fuel inlet and the second fuel inlet opening only when fuel flows from the low-pressure fuel intake passage into the high-pressure fuel supply body, and a discharge-side tongue interposed between the first fuel outlet and the second fuel outlet opening only when fuel flows from the high-pressure fuel supply body into the high-pressure fuel discharge passage, the high-pressure fuel supply body including: a casing housing the valve assembly in a recess; a sleeve housed in the recess in surface contact with the valve assembly; a piston slidably inserted into the sleeve forming a fuel pressurization chamber in cooperation with the sleeve, the piston pressurizing fuel flowing into the fuel pressurization chamber from the low-pressure fuel intake passage; and a securing member securing the valve assembly and the sleeve inside the recess by pressing on an outer circumferential portion of the sleeve, a back-pressure chamber connected to the high-pressure fuel discharge passage being formed in the casing so as to face a central portion of the first plate.

According to another aspect of the present invention, there is provided a high-pressure fuel pump comprising: a valve assembly disposed between a low-pressure fuel intake passage and a high-pressure fuel discharge passage, the valve assembly opening and closing the low-pressure fuel intake passage and the high-pressure fuel discharge passage; and a high-pressure fuel supply body for pressurizing low-pressure fuel flowing from the low-pressure fuel intake passage and discharging pressurized fuel into the high-pressure fuel discharge passage, the valve assembly including: a first plate having a first fuel inlet connected to the low-pressure fuel intake passage, and a first fuel outlet connected to the high-pressure fuel discharge passage; a second plate having a second fuel inlet having inside dimensions larger than inside dimensions of the first fuel inlet, and a second fuel outlet having inside dimensions smaller than inside dimensions of the first fuel outlet; and a thin, flat valve main body positioned between the first plate and the second plate, the valve main body having an intake-side tongue interposed between the first fuel inlet and the second fuel inlet opening only when fuel flows from the low-pressure fuel intake passage into the high-pressure fuel supply body, and a discharge-side tongue interposed between the first fuel outlet and the second fuel outlet opening only when fuel flows from the high-pressure fuel supply body into the high-pressure fuel discharge passage, the high-pressure fuel supply body including: a casing housing the valve assembly in a recess; a sleeve housed in the recess in the casing in surface contact with the valve assembly; a piston slidably inserted into the sleeve forming a fuel pressurization chamber in cooperation with the sleeve; and a securing member securing the valve assembly and the sleeve inside the recess by pressing on an outer circumferential portion of the sleeve, a pressing member being provided for integrating the casing and the valve assembly and for pressing the valve assembly towards the casing.

DETAILED DESCRIPTION OF THE PREFERRED EMBODIMENTS

Figure 5:
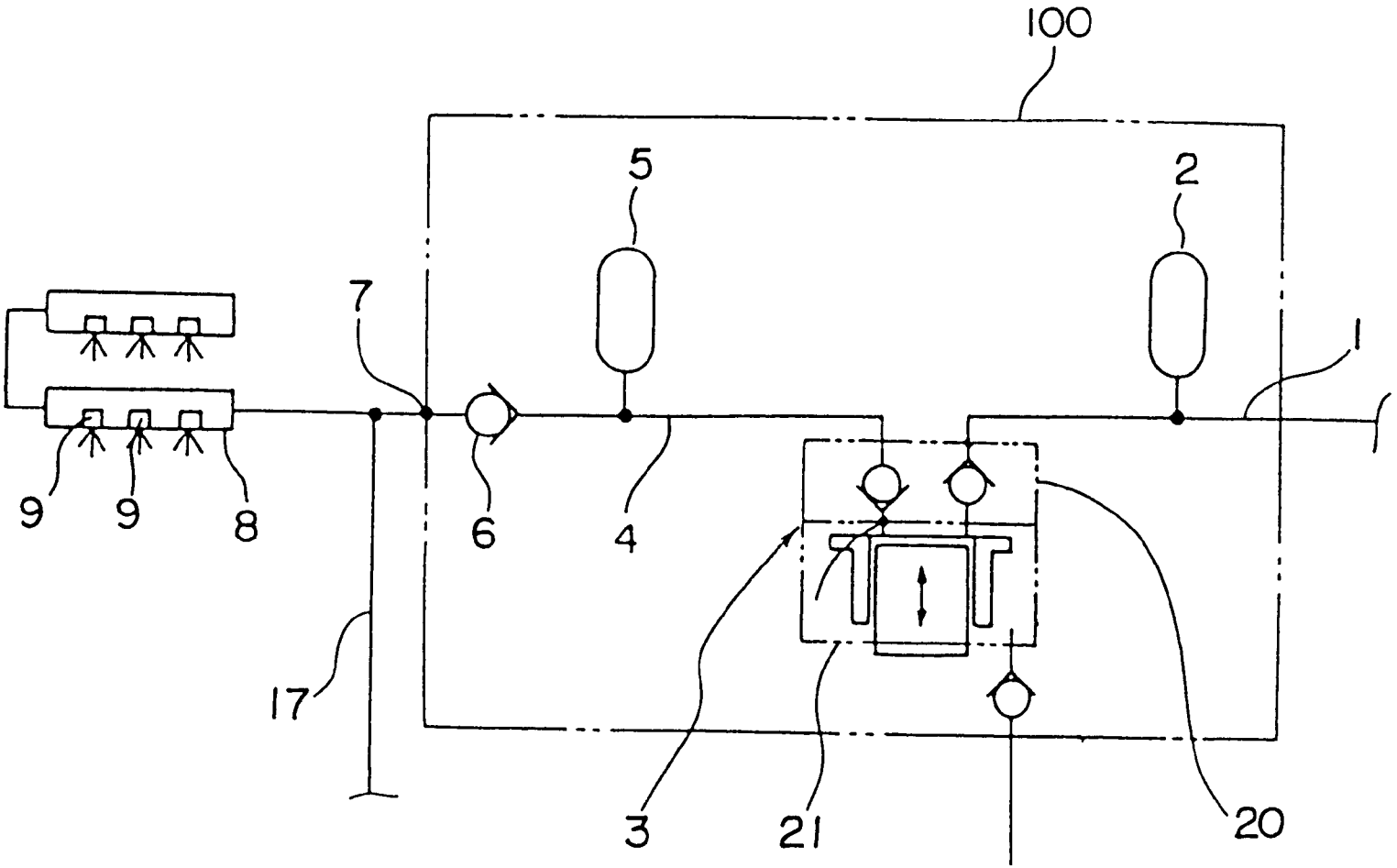
FIG. 5 is a block diagram showing the construction of a conventional high-pressure fuel supply assembly.
Figure 6:
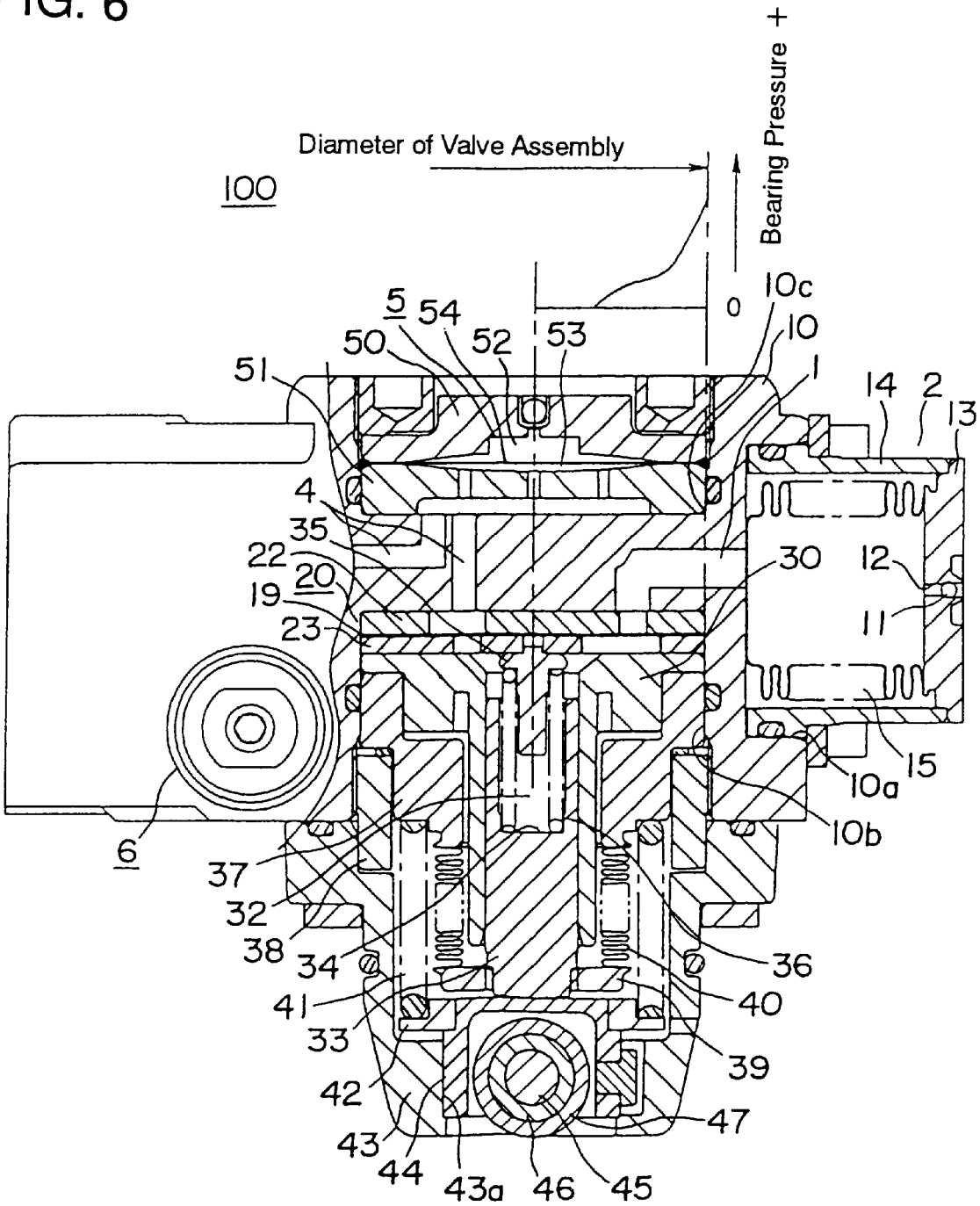
FIG. 6 is a cross section of a conventional high-pressure fuel supply assembly.

A high-pressure fuel supply assembly 200 according to the present invention will be explained below. Parts the same as or corresponding to those in FIGS. 5 to 7 above will be given the same numbering.

Embodiment 1

Figure 1:
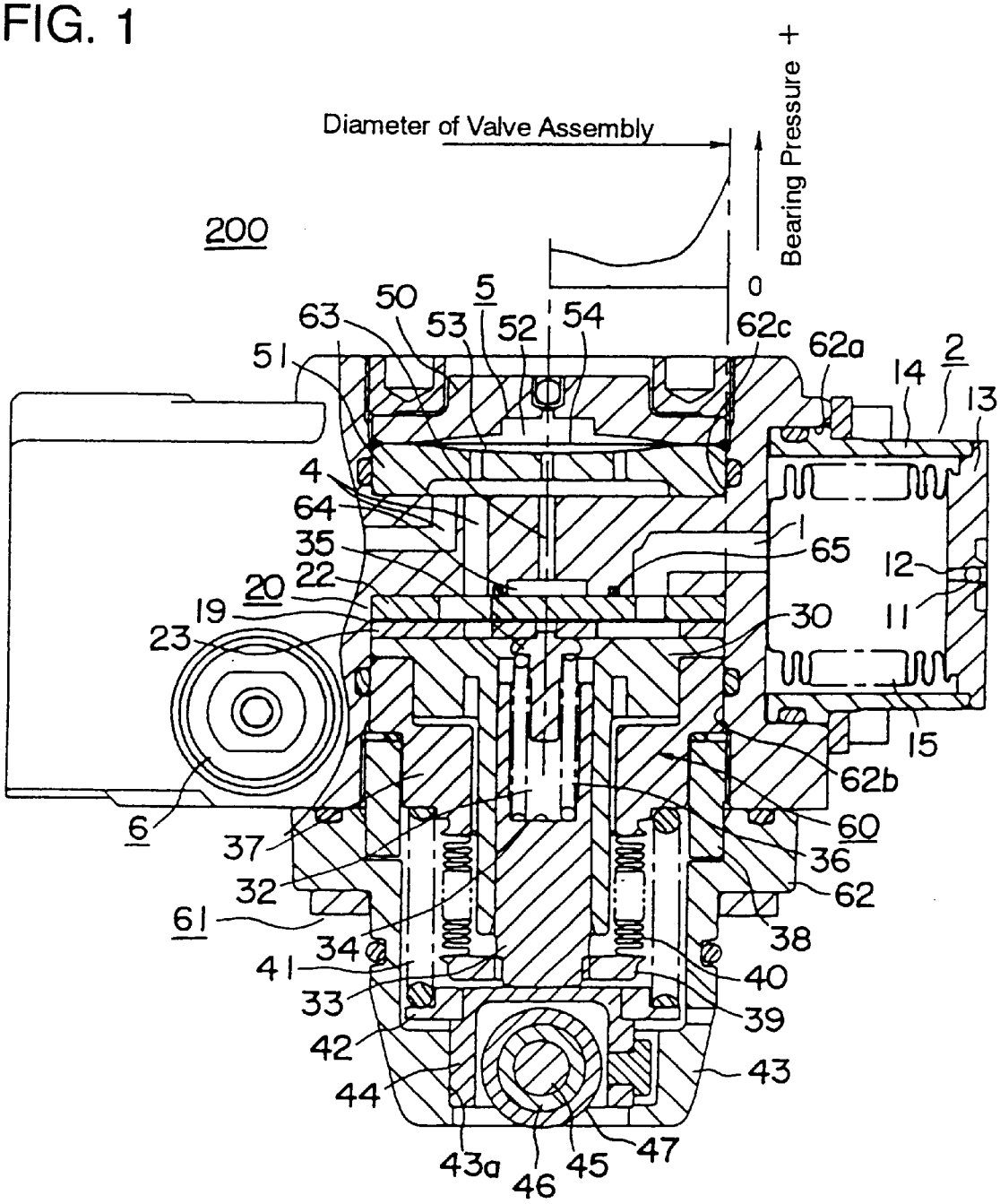
FIG. 1 is cross section of a high-pressure fuel supply assembly incorporating a high-pressure fuel pump according to Embodiment 1 of the present invention.

FIG. 1 is a cross section of a high-pressure fuel supply assembly 200. This high-pressure fuel supply assembly 200 includes: a low-pressure damper 2 for absorbing surges in low-pressure fuel, the low-pressure damper 2 being connected to a low-pressure fuel intake passage 1 through which flows low-pressure fuel from a low-pressure fuel pump (not shown); a high-pressure fuel pump 60 for pressurizing low-pressure fuel from the low-pressure damper 2; a high-pressure damper 5 for absorbing surges in the high-pressure fuel flowing through a high-pressure fuel discharge passage 4 connected to the high-pressure fuel pump 3; and a check valve for improving the starting of an engine by maintaining fuel in delivery pipes 8 at high pressure even when the engine is stopped, the check valve being disposed between the high-pressure damper 5 and a fuel supply port 7 and opening when the fuel pressure on the delivery pipe 8 side is lower than the fuel pressure on the high-pressure damper 5 side.

The above low-pressure damper 2 is mounted in a first recess 62*a* in a casing 62. The low-pressure damper 2 includes: a cylindrical holder 14; a base 13 having a ball 11 disposed in a bore 12; and a metal bellows 15 disposed inside the holder 14.

The above high-pressure fuel pump 60 includes: a valve assembly 20 for opening and closing the low-pressure fuel intake passage 1 and the high-pressure fuel discharge passage 4; and a high-pressure fuel supply body 61 for pressurizing low-pressure fuel and discharging it into the high-pressure fuel discharge passage 4.

Figure 7:
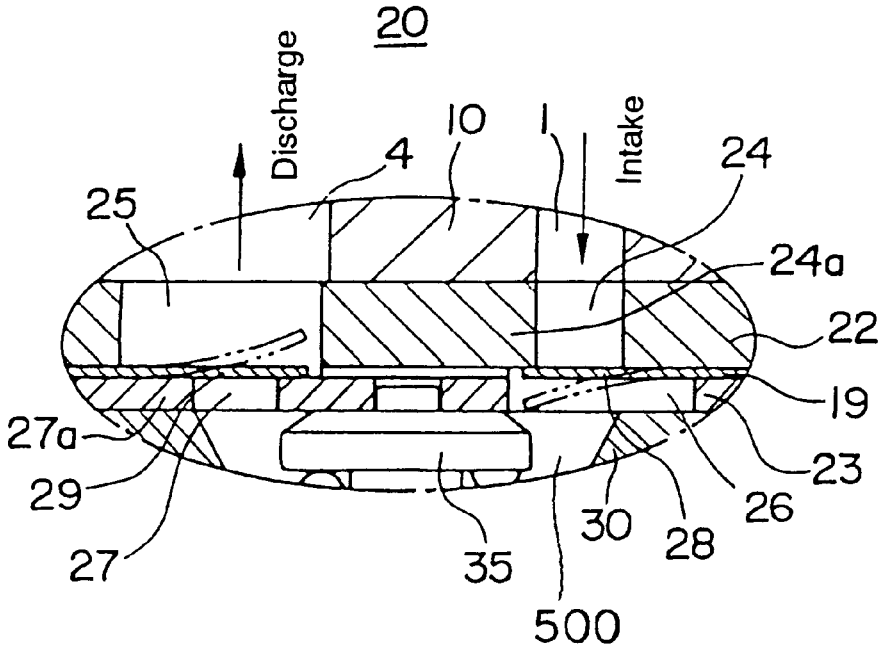
FIG. 7 is a cross section of the valve assembly of the high-pressure fuel pump in FIG. 6.

As shown in FIG. 7 above, the valve assembly 20 is composed of a first plate 22, a second plate 23, and a thin, flat valve main body 19 positioned between the first and second plates 22 and 23. A first fuel inlet 24 connected to the low-pressure fuel intake passage 1 and a first fuel outlet 25 connected to the high-pressure fuel discharge passage 4 are formed in the first plate 22, the inside dimensions of the first fuel outlet 25 being larger than the inside dimensions of the first fuel inlet 24. A second fuel inlet 26 having inside dimensions larger than those of the first fuel inlet 24 and a second fuel outlet 27 having inside dimensions smaller than those of the first fuel outlet 25 are formed in the second plate 23. The valve main body 19 is provided with an intake-side tongue 28 interposed between the first fuel inlet 24 and the second fuel inlet 26, and a discharge-side tongue 29 interposed between the first fuel outlet 25 and the second fuel outlet 27.

The high-pressure fuel supply body 61 includes: a casing 62 housing the valve assembly 20 in a second recess 62*b;* a cylindrical sleeve 30 housed in the second recess 62*b* in surface contact with the second plate 23; a piston 33 slidably inserted into the sleeve 30 forming a fuel pressurization chamber 32 in cooperation with the sleeve 30; and a first spring 36 disposed between a recessed bottom surface 34 of the piston 33 and a holder 35, the spring 36 applying force to the piston 33 in a direction which expands the volume of the fuel pressurization chamber 32.

The high-pressure fuel supply body 61 also includes: a housing 37 fitted over the sleeve 30; a ring-shaped securing member 38 securing the valve assembly 20, the sleeve 30, and the housing 37 inside the second recess 62*b* of the casing 62 by fitting over the housing 37 and engaging the second recess 62*b* of the casing 62 by a male thread portion formed on an outer circumferential surface of the securing member 38; a metal bellows 40 disposed between the housing 37 and a receiving portion 39; a second spring 41 compressed and disposed around the outside of the bellows 40 between the housing 37 and a holder 42; and a bracket 43 disposed so as to surround the second spring 41, the bracket 43 being secured to the casing 62 by a bolt (not shown).

The high-pressure fuel supply body 61 also includes: a tappet 44 slidably disposed in a slide bore 43*a* in an end portion of the bracket 43; a pin 45 rotatably suspended in the tappet 44; a bush 46 rotatably disposed on the pin 45; and a cam roller 47 rotatably disposed on the bush 46, the cam roller 47 contacting a cam (not shown) secured to a cam shaft (not shown), following the shape thereof, and reciprocating the piston 33.

The above high-pressure damper 5 is screwed into a third recess 62*c* in the casing 62. The high-pressure damper 5 includes: a first case 50; a second case 51 disposed opposite the first case 50, the second case 51 forming a space in cooperation with the first case 50; and a thin, flat disk-shaped stainless steel diaphragm 54 dividing the space into a back-pressure chamber 52 charged with high-pressure gas and a buffer chamber 53. The diaphragm 54 moves so that the pressure of the fuel flowing into the buffer chamber 53 from the high-pressure fuel discharge passage 4 is equalized with the pressure of the high-pressure gas in the back-pressure chamber 52, thereby changing the volume inside the buffer chamber and absorbing surges in the fuel in the high-pressure fuel discharge passage 4.

A connecting passage 63 having one end connected to the high-pressure discharge passage 4 is formed in the casing 62 on the axis of the piston. A back-pressure chamber 64 facing a central portion of the first plate 22 is also formed in the casing 62. This back-pressure chamber 64 is connected to the connecting passage 63. An O-ring 65 for forming an airtight seal between the first plate 22 and an outer circumferential portion of the back-pressure chamber 64 is disposed on the outer circumferential portion of the back-pressure chamber 64.

In a high-pressure fuel supply assembly 200 having the above construction, the piston 33 is reciprocated by the rotation of the cam secured to the cam shaft of an engine (not shown) by means of the cam roller 47, the bush 46, the pin 45, and the tappet 44.

When the piston 33 is descending (during the fuel intake stroke), the volume of the inside of the fuel pressurization chamber 32 increases and the pressure inside the fuel pressurization chamber 32 decreases. When the pressure inside the fuel pressurization chamber 32 falls below the pressure at the first fuel inlet 24, the intake-side tongue 28 of the valve main body 19 bends towards the second fuel inlet 26, allowing fuel in the low-pressure fuel supply passage 1 to flow through the first fuel inlet 24 into the fuel pressurization chamber 32.

When the piston 33 is ascending (during the fuel discharge stroke), the pressure inside the fuel pressurization chamber 32 increases, and when the pressure inside the fuel pressurization chamber 32 rises above the pressure at the first fuel outlet 25, the discharge-side tongue 29 of the valve main body 19 bends towards the first fuel outlet 25, allowing fuel in the fuel pressurization chamber 32 to flow through the first fuel outlet 25 and the fuel discharge passage 4 into the high-pressure damper 5, where fuel pressure surges are absorbed. High-pressure fuel is then supplied to the delivery pipes 8 via the check valve 6 and the fuel supply port 7, and thereafter supplied to the fuel injection valves 9, which inject fuel into each of the cylinders (not shown) of the engine.

Whereas in a conventional assembly the pressure bearing on the central portion was extremely low, in a high-pressure fuel pump 60 of a high-pressure fuel supply assembly 200 of the above construction, as shown in FIG. 1, the pressure bearing on the central portion is increased by subjecting the central portion to the load of the discharged high-pressure fuel through the back-pressure chamber 64, and the pressure bearing on the outer circumferential portion is also maintained at the level of a conventional assembly, ensuring bearing pressure over the entire surface, so that the formation of undesirable gaps between the second plate 23 and the discharge-side tongue 29 is suppressed during the fuel intake stroke, and similarly, the formation of undesirable gaps between the first plate 22 and the intake-side tongue 28 is suppressed during the fuel discharge stroke. Consequently, the volumetric efficiency will not drop suddenly even if the fuel discharge pressure is raised.

Moreover, the magnitude of the load at the central portion of the valve assembly 20 can be controlled by changing the fuel discharge pressure and the radial dimensions of the back-pressure chamber 64.

Figure 2:
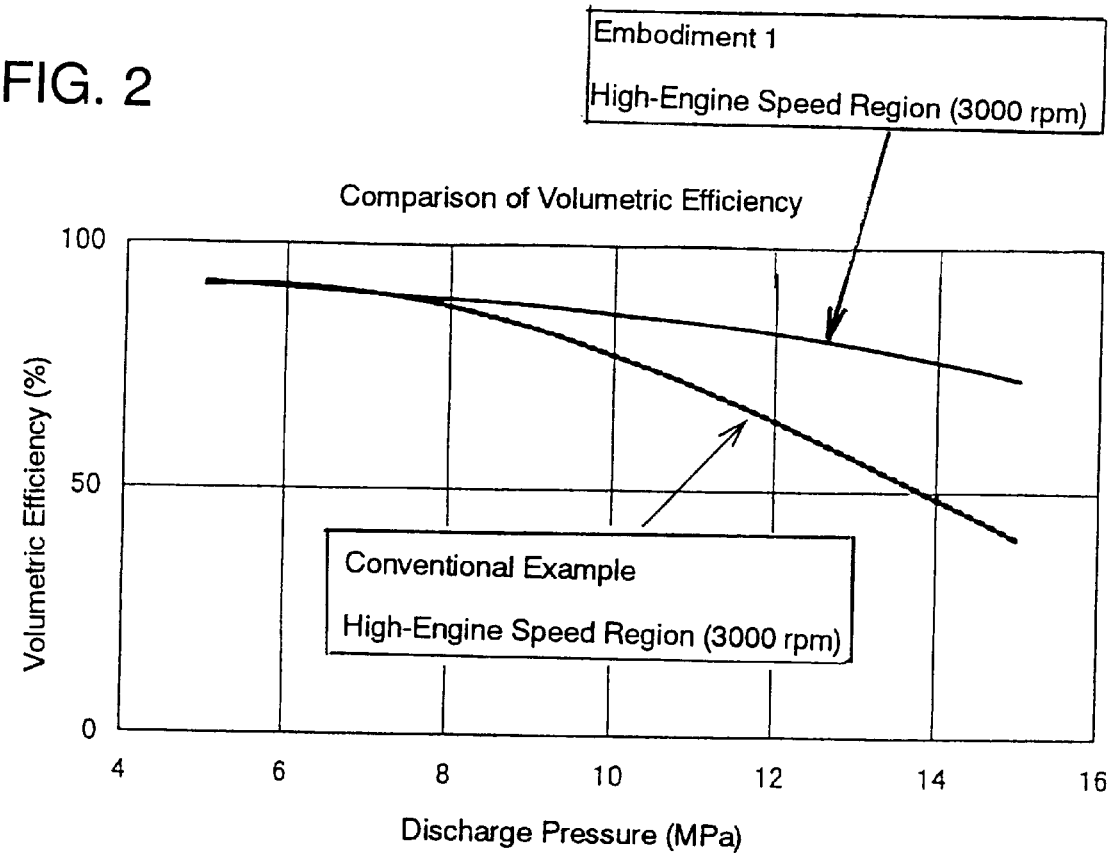
FIG. 2 is a graph showing the relationship between fuel discharge pressure and volumetric efficiency in a high-pressure fuel pump.

FIG. 2 is a graph showing the relationship between the discharge pressure of the fuel from the fuel pressurization chamber 32 and volumetric efficiency and is based on data obtained in experiments conducted by the present inventors comparing a comparative example with Embodiment 1 of the present invention under conditions where an engine was running at 3000 rpm. From these results, it can be seen that drops in volumetric efficiency when the fuel discharge pressure was high were significantly reduced in Embodiment 1 of the present invention compared to the comparative example.

Embodiment 2

Figure 3:
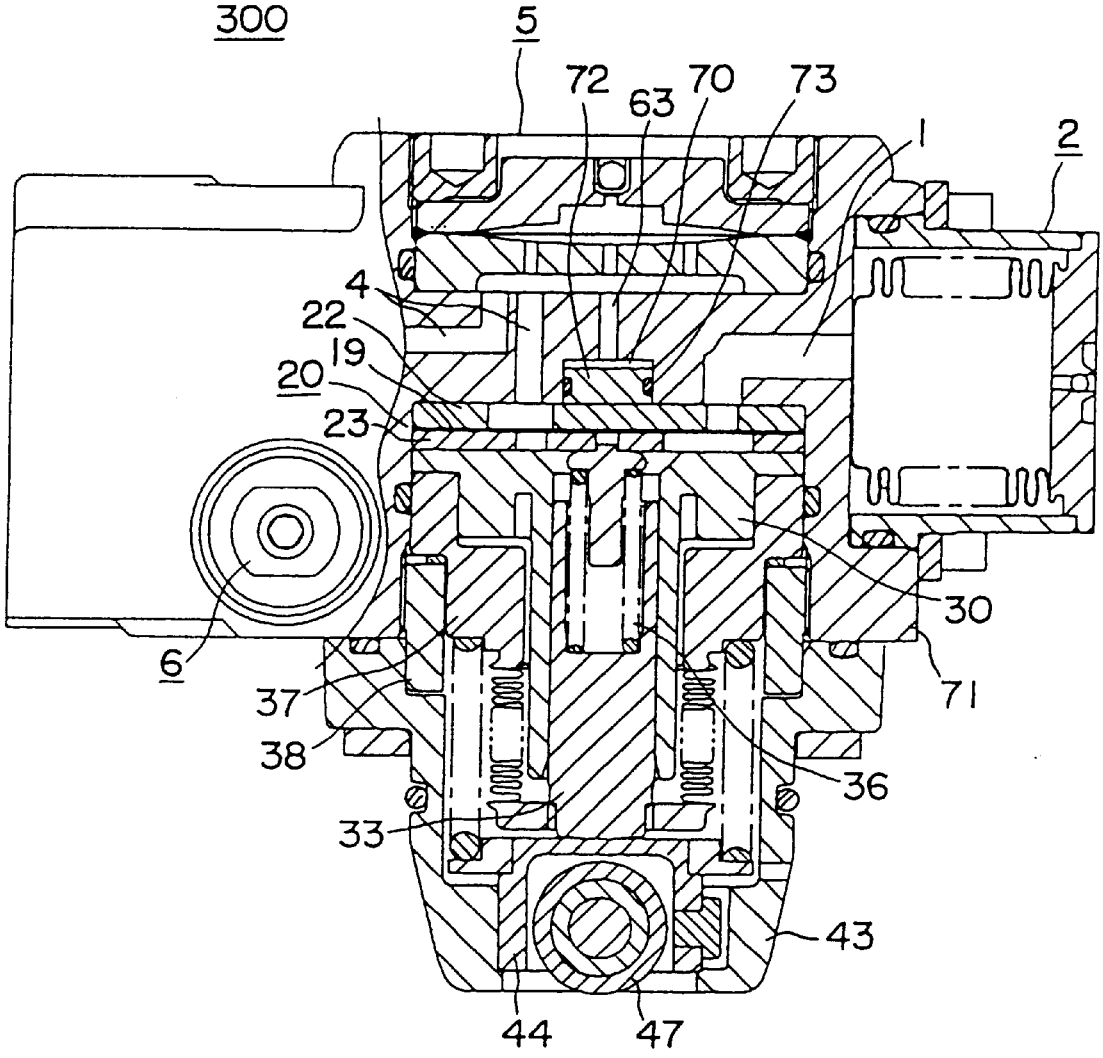
FIG. 3 is a cross section of a high-pressure fuel supply assembly incorporating a high-pressure fuel pump according to Embodiment 2 of the present invention.

FIG. 3 is a cross section of a high-pressure fuel supply assembly 300 according to Embodiment 2 of the present invention, in which an equalizing member 72 is disposed in a back-pressure chamber 70 formed in a casing 71. An O-ring 73 for forming a tight seal between an outer wall of the equalizing member 72 and an inner wall of the back-pressure chamber 70 is disposed between the outer wall and the inner wall.

The rest of the construction is the same as for Embodiment 1 and explanation thereof will be omitted.

In this embodiment, high-pressure fuel flowing into the back-pressure chamber 70 from the high-pressure fuel discharge passage 4 is stopped by the equalizing member 72, and is further prevented from flowing to the first plate 22 side by the O-ring 73.

Furthermore, because the load resulting from the discharged fuel acts on the first plate 22 through the equalizing member, a uniform load is applied to the first plate 22, suppressing the formation of gaps in the valve assembly 20 proportionately.

Embodiment 3

Figure 4:
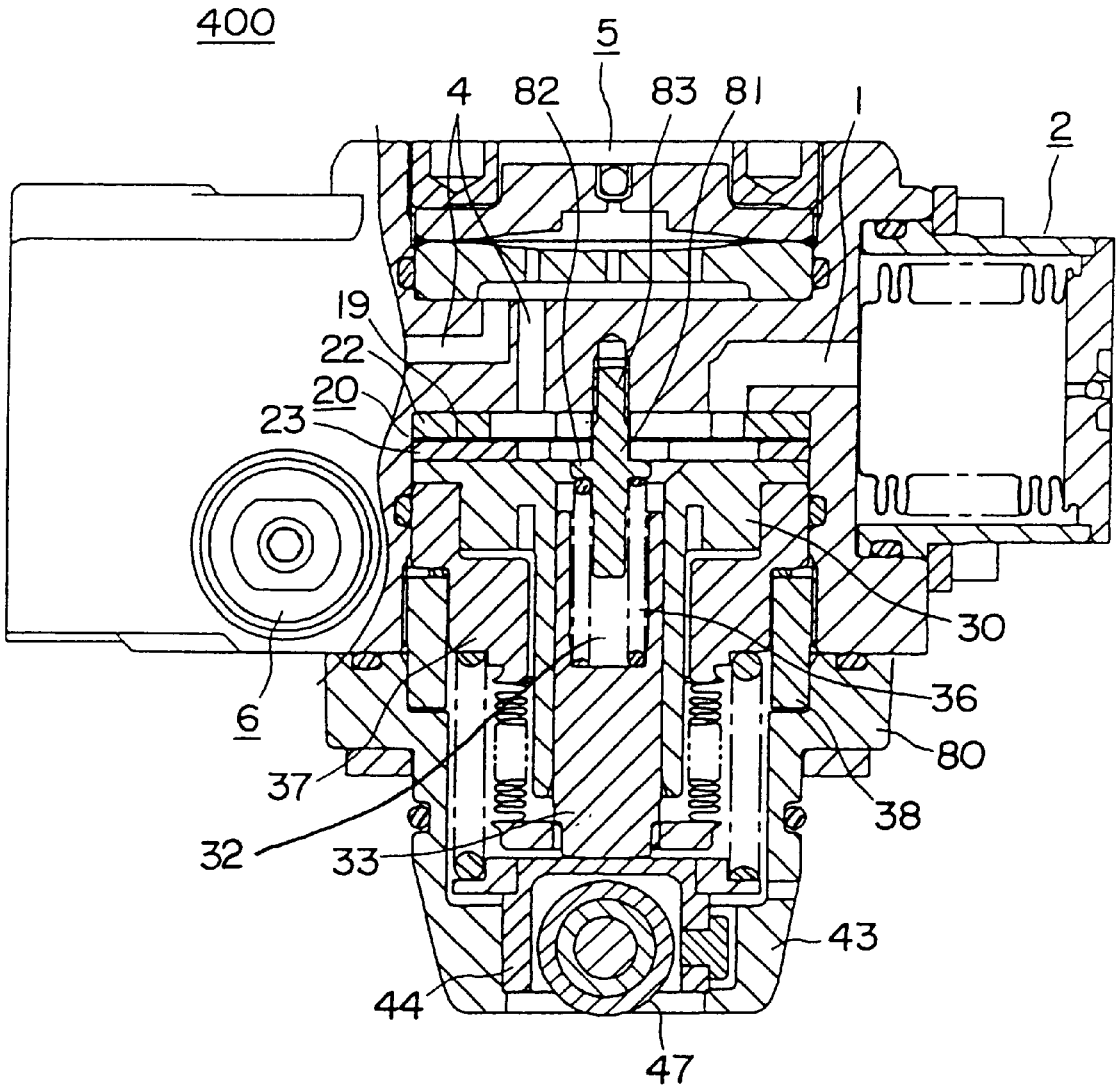
FIG. 4 is a cross section of a high-pressure fuel supply assembly incorporating a high-pressure fuel pump according to Embodiment 3 of the present invention.

FIG. 4 is a cross section of a high-pressure fuel supply assembly 400 according to Embodiment 3 of the present invention, in which a casing 80 and the valve assembly 20 are integrated by a pressing member 81.

The pressing member 81 has a projection 82 to which one end of the spring 36 is attached, and a thread portion 83 engaging the casing 80 and the first plate 22. The pressing member 81 presses the central portion of the valve assembly 20 towards the high-pressure damper 5 by means of the projection 82.

In Embodiment 3, an outer circumferential portion of the valve assembly 20 is subjected to a load pressing towards the high-pressure damper 5 by means of the securing member 38, and the central portion thereof is subjected to a load pressing towards the high-pressure damper 5 by means of the pressing member 81 so that the valve assembly 20 is firmly held all over by the casing 80, the sleeve 30, and the projection 82. Consequently, the formation of gaps between the second plate 23 and the discharge-side tongue 29 during the fuel intake stroke and the formation of gaps between the first plate 22 and the intake-side tongue 28 during the fuel discharge stroke are suppressed, and thus the volumetric efficiency will not drop significantly even if the fuel discharge pressure is high.

As explained above, a high-pressure fuel pump according one aspect of the present invention comprises a back-pressure chamber connected to the high-pressure fuel discharge passage being formed in the casing so as to face a central portion of the first plate. Therefore, load is also applied to the central portion so that the formation of undesirable gaps between the second plate and the discharge-side tongue is suppressed during the fuel intake stroke in the vicinity of the central portion where the bearing pressure is conventionally extremely low, and similarly, the formation of undesirable gaps between the first plate and the intake-side tongue are suppressed during the fuel discharge stroke in the vicinity of the central portion where the bearing pressure is conventionally extremely low. Consequently, the volumetric efficiency will not drop significantly even if the fuel discharge pressure is raised. The amplitude of any drops in volumetric efficiency can also be minimized. Furthermore, the occurrence of fretting in the valve assembly due to the formation of gaps is prevented.

According to one form of the high-pressure fuel pump, the back-pressure chamber may be disposed on the axis of the piston. Therefore, biases in the pressing load distribution acting on the valve assembly can be prevented, and the formation of gaps can be further suppressed.

According to another form of the high-pressure fuel pump, an O-ring for forming an airtight seal between the first plate and an outer circumferential portion of the back-pressure chamber may be disposed between the first plate and the outer circumferential portion. Therefore, high-pressure fuel is prevented from flowing from the back-pressure chamber to the valve assembly side so that the volumetric efficiency will not drop significantly even if the fuel discharge pressure is raised.

According to still another form of the high-pressure fuel pump, an equalizing member for uniformly pressing the first plate may be disposed in surface contact with the first plate within the back-pressure chamber. Therefore, high-pressure fuel flowing into the back-pressure chamber from the high-pressure fuel discharge passage is stopped by the equalizing member and is prevented from flowing to the first plate side so that the volumetric efficiency will not drop significantly even if the fuel discharge pressure is raised. Furthermore, a uniform load is applied to the first plate, suppressing the formation of gaps in the valve assembly proportionately.

According to one form of the high-pressure fuel pump, an O-ring for forming an airtight seal between an outer wall of the equalizing member and an inner wall of the back-pressure chamber may be disposed between the outer wall and the inner wall. Therefore, high-pressure fuel is prevented from flowing from the back-pressure chamber to the valve assembly side so that the volumetric efficiency will not drop significantly even if the fuel discharge pressure is raised.

According to another aspect of the present invention, the high-pressure fuel pump comprises a pressing member being provided for integrating the casing and the valve assembly and for pressing the valve assembly towards the casing. Therefore, load is also applied to the central portion so that the formation of undesirable gaps between the second plate and the discharge-side tongue is suppressed during the fuel intake stroke, and similarly, the formation of undesirable gaps between the first plate and the intake-side tongue are suppressed during the fuel discharge stroke, and consequently the volumetric efficiency will not drop significantly even if the fuel discharge pressure is raised. Furthermore, the occurrence of fretting in the valve assembly due to the formation of gaps is prevented.

According to one form of the high-pressure fuel pump, the pressing member may comprise: a projection for attaching one end of a spring which elastically presses the piston, the projection pressing the second plate; and a thread portion engaging the casing. Therefore, the holder conventionally holding the spring can be modified and used as a pressing member, enabling improvements to the volumetric efficiency without increasing the number of parts.

What is claimed is:

1. A high-pressure fuel pump comprising:

a valve assembly disposed between a low-pressure fuel intake passage and a high-pressure fuel discharge passage, said valve assembly opening and closing said low-pressure fuel intake passage and said high-pressure fuel discharge passage; and a high-pressure fuel supply body for pressurizing low-pressure fuel flowing from said low-pressure fuel intake passage and discharging pressurized fuel into said high-pressure fuel discharge passage, said valve assembly including:

a first plate having a first fuel inlet connected to said low-pressure fuel intake passage, and a first fuel outlet connected to said high-pressure fuel discharge passage;

a second plate having a second fuel inlet having inside dimensions larger than inside dimensions of said first fuel inlet, and a second fuel outlet having inside dimensions smaller than inside dimensions of said first fuel outlet; and a thin, flat valve main body positioned between said first plate and said second plate, said valve main body having an intake-side tongue interposed between said first fuel inlet and said second fuel inlet opening only when fuel flows from said low-pressure fuel intake passage into said high-pressure fuel supply body, and a discharge-side tongue interposed between said first fuel outlet and said second fuel outlet opening only when fuel flows from said high-pressure fuel supply body into said high-pressure fuel discharge passage, said high-pressure fuel supply body including:

a casing housing said valve assembly in a recess;

a sleeve housed in said recess in surface contact with said valve assembly;

a piston slidably inserted into said sleeve forming a fuel pressurization chamber in cooperation with said sleeve, said piston pressurizing fuel flowing into said fuel pressurization chamber from said low-pressure fuel intake passage; and a securing member securing said valve assembly and said sleeve inside said recess by pressing on an outer circumferential portion of said sleeve, a back-pressure chamber connected to said high-pressure fuel discharge passage being formed in said casing so as to face a central portion of said first plate.

2. The high-pressure fuel pump according to claim 1 wherein said back-pressure chamber is disposed on the axis of said piston.

3. The high-pressure fuel pump according to claim 1 wherein an O-ring for forming an airtight seal between said first plate and an outer circumferential portion of said back-pressure chamber is disposed between said first plate and said outer circumferential portion.

4. The high-pressure fuel pump according to claim 1 wherein an equalizing member for uniformly pressing said first plate is disposed in surface contact with said first plate within said back-pressure chamber.

5. The high-pressure fuel pump according to claim 4 wherein an O-ring for forming an airtight seal between an outer wall of said equalizing member and an inner wall of said back-pressure chamber is disposed between said outer wall and said inner wall.

6. A high-pressure fuel pump comprising:

a valve assembly disposed between a low-pressure fuel intake passage and a high-pressure fuel discharge passage, said valve assembly opening and closing said low-pressure fuel intake passage and said high-pressure fuel discharge passage; and a high-pressure fuel supply body for pressurizing low-pressure fuel flowing from said low-pressure fuel intake passage and discharging pressurized fuel into said high-pressure fuel discharge passage, said valve assembly including:

a first plate having a first fuel inlet connected to said low-pressure fuel intake passage, and a first fuel outlet connected to said high-pressure fuel discharge passage;

a second plate having a second fuel inlet having inside dimensions larger than inside dimensions of said first fuel inlet, and a second fuel outlet having inside dimensions smaller than inside dimensions of said first fuel outlet; and a thin, flat valve main body positioned between said first plate and said second plate, said valve main body having an intake-side tongue interposed between said first fuel inlet and said second fuel inlet opening only when fuel flows from said low-pressure fuel intake passage into said high-pressure fuel supply body, and a discharge-side tongue interposed between said first fuel outlet and said second fuel outlet opening only when fuel flows from said high-pressure fuel supply body into said high-pressure fuel discharge passage, said high-pressure fuel supply body including:

a casing housing said valve assembly in a recess;

a sleeve housed in said recess in said casing in surface contact with said valve assembly;

a piston slidably inserted into said sleeve forming a fuel pressurization chamber in cooperation with said sleeve; and a securing member securing said valve assembly and said sleeve inside said recess by pressing on an outer circumferential portion of said sleeve, a pressing member being provided for integrating said casing and said valve assembly and for pressing said valve assembly towards said casing.

7. The high-pressure fuel pump according to claim 6 wherein said pressing member comprises:

a projection for attaching one end of a spring which elastically presses said piston, said projection pressing said second plate; and a thread portion engaging said casing.

* * * * *